US006150982A

United States Patent [19]

Bergstedt et al.

[11] Patent Number: 6,150,982

[45] Date of Patent: Nov. 21, 2000

[54] ANTENNA ARRANGEMENT

[75] Inventors: Leif Bergstedt, Sjömarken; Spartak Georgian, Göteborg, both of Sweden

[73] Assignee: Telefonaktiebolaget LM Ericsson, Stockholm, Sweden

[21] Appl. No.: 09/196,166

[22] Filed: Nov. 20, 1998

[30] Foreign Application Priority Data

Nov. 21, 1997 [SE] Sweden ..... 9704295

[51] Int. Cl.[7] ..... H01Q 1/38

[52] U.S. Cl. ..... 343/700 MS; 343/846

[58] Field of Search ..... 343/700 MS, 824, 343/826, 829, 830, 846, 848; H01Q 1/38

[56] References Cited

U.S. PATENT DOCUMENTS

| | | | |
|---|---|---|---|
| 4,521,755 | 6/1985 | Carlson et al. | 333/244 |
| 4,899,164 | 2/1990 | McGrath | 343/700 MS |
| 5,635,942 | 6/1997 | Kushihi et al. | 343/700 MS |
| 5,844,524 | 12/1998 | Kraiczyk et al. | 343/700 MS |
| 5,898,405 | 4/1999 | Iwasaki | 343/700 MS |
| 5,963,168 | 10/1999 | Brennan | 343/700 MS |

FOREIGN PATENT DOCUMENTS 2 147 744 5/1985 United Kingdom .

*Primary Examiner*—Hoanganh Le
*Attorney, Agent, or Firm*—Burns, Doane, Swecker & Mathis, L.L.P.

[57] ABSTRACT

A single-frequency antenna arrangement includes a ground plane, a dielectric substrate, a first antenna contour located on a first side of the dielectric substrate and a second antenna contour located on second side of the dielectric substrate. The first antenna contour and the second antenna contour have substantially the same dimensions in their longitudinal directions and transverse directions. The first antenna contour and the second antenna contour are galvanically interconnected by at least one connection.

10 Claims, 2 Drawing Sheets

ANTENNA ARRANGEMENT

This application claims priority under 35 U.S.C. §§119 and/or 365 to 9704295-6 filed in Sweden on Nov. 21, 1997; the entire content of which is hereby incorporated by reference.

BACKGROUND

The present invention relates to a microstrip arrangement, preferably a single-frequency antenna arrangement for use within the microwave range.

Microstrip technology is commonly used in arrangements within higher frequency ranges, for example the microwave range. Microstrip arrangements usually comprise a plane layer of an electrically conductive material arranged on a substrate of dielectric material. A common area of application for microstrip arrangements is antennas.

An extremely important and cost-influencing parameter in previously known microstrip arrangements is the material that is used as the dielectric substrate. The material for the dielectric substrate is extremely important in known microstrip arrangements on account of inter alia the field losses that occur in the dielectric. In order to minimize these field losses, it has been necessary to use dielectric materials that are relatively expensive in previously known microstrip arrangements.

A further problem may be material variations between different deliveries of one and the same dielectric material from one and the same manufacturer.

One known way of reducing the field losses in the dielectric substrate in a microstrip arrangement is to provide the electrically conductive material with a non-plane shape. A disadvantage of this solution is that a non-plane shape drives up the manufacturing cost. Certain losses also occur in the electrically conductive material itself, compared with when the material is of plane shape.

Another type of loss that may arise on account of the properties of the dielectric material is reflection losses, in other words losses at the point where the microstrip arrangement is connected to other equipment, in the case of an antenna especially transmitting or receiving equipment.

American Patent U.S. Pat. No. 4,521,755 discloses an arrangement which aims to improve the electrical properties in a transmission line made using strip line technology. This arrangement is dependent for its functioning on being positioned in a longitudinal cavity formed in a solid metal piece, which would seem to have the effect of making the arrangement bulky as well as costly to manufacture. The arrangement also requires the use of relatively expensive dielectric material, for example RT/DUROID 6010®.

SUMMARY

One problem that is solved by means of the present invention is therefore that of minimizing, in an arrangement made using microstrip technology, preferably a single-frequency antenna arrangement, the field losses that are caused by the dielectric material on which the conductive material is arranged.

Another problem that is solved by means of the present invention is that of minimizing the influence of material variations in the dielectric material in a microstrip arrangement, preferably a single-frequency antenna arrangement.

A further problem is solved by means of the present invention is that of reducing the reflection losses that arise in a microstrip arrangement, preferably a single-frequency antenna arrangement.

These problems are solved by means of a single-frequency antenna arrangement that comprises a dielectric substrate, a first antenna contour located on one side of the dielectric substrate and a second antenna contour located on the second side of the dielectric substrate.

The first and the second antenna contours have essentially the same dimensions in the longitudinal direction and the transverse direction, are galvanically interconnected by means of at least one connection, and extend essentially parallel to one another on either side of the dielectric material. As a result of this design of the antenna arrangement, the field losses in the dielectric material will be very considerably reduced, and in practice a resultant antenna contour is obtained, which, with regard to its electrical characteristics, appears to be suspended in the air.

The arrangement also comprises a feed point for the antenna contours, and also a ground plane which is preferably located on that side of the antenna arrangement towards which the antenna arrangement is not intended to radiate.

In a preferred embodiment, the first and the second antenna contours are designed as a group of radiating elements which are interconnected with the aid of connecting lines.

Measurements on this type of microstrip antenna have demonstrated considerably reduced reflection losses compared with previously known microstrip antennas. The reduction is of the order of magnitude of 6 dB.

BRIEF DESCRIPTION OF THE DRAWINGS

The invention is described in greater detail below with the aid of examples of embodiments, and with reference to the attached drawings, in which.

DETAILED DESCRIPTION

Figure 1:
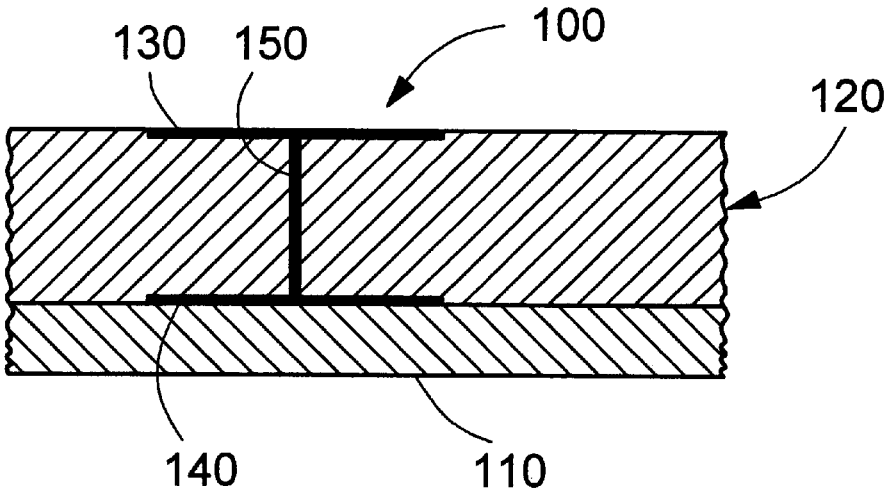
FIG. 1 shows a diagrammatic cross-section of an arrangement according to the invention, seen from the front in the longitudinal direction of the arrangement.

FIG. 1 shows a diagrammatic cross-section of a single-frequency antenna arrangement 100 according to the invention, seen from the front in the longitudinal direction of the arrangement 100. As can be seen from FIG. 1, the invention comprises a first and a second antenna contour 130, 140 located on either side of a dielectric substrate 120.

The first and the second antenna contours 130, 140 have essentially the same dimensions in the longitudinal direction and the transverse direction, extend essentially parallel to one another on either side of the dielectric material 120 and are, in relation to one another, symmetrically located on either side of the dielectric substrate 120.

The antenna arrangement 100 according to the invention also comprises a galvanic connection 150 between the first and the second antenna contours 130, 140, shown in FIG. 1 as a connection 150 that extends, symmetrically in relation to the two antenna contours 130, 140, through the dielectric substrate 120. A suitable type of connection is via holes, in other words holes that are made by means of, for example, mechanical drilling, laser drilling or etching, and are then made electrically conductive by plating with an electrically conductive material.

The symmetrical positioning of the connection 150, and the fact that it extends through the dielectric substrate 120, are to be seen only as examples of its positioning. The connection 150 may be positioned in a great many other positions in relation to the antenna contours 130, 140 and the dielectric substrate 120, which will be described in greater detail below.

The antenna arrangement 100 suitably also includes a ground plane 110, located on one side of and parallel to one antenna contour 140. In the figures and below, the ground plane 110 will be shown as separated from the most closely located antenna contour 140 with the aid of dielectric material that covers it completely. Further possibilities are, for example, distance pieces made of dielectric material or an arrangement in which the antenna contours 130, 140 are, with their dielectric material 120, inserted into a groove in a structure which itself constitutes a ground plane.

Figure 2A:
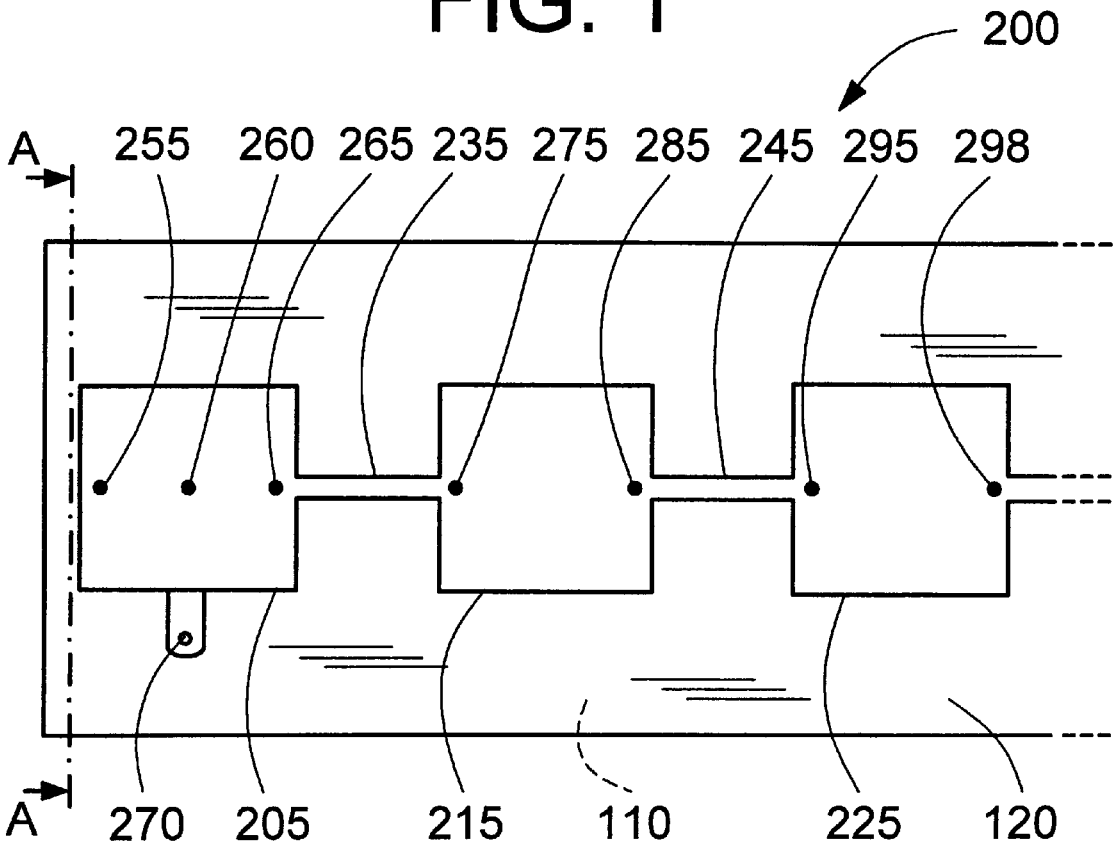
FIG. 2*a* shows an arrangement according to a preferred embodiment of the invention, seen from above.

FIG. 2*a* shows an antenna arrangement 200 according to a preferred embodiment of the invention, seen from above. In this embodiment, each antenna contour comprises a number of radiating elements 205, 215, 225 which are interconnected by means of preferably straight connections 235, 245.

According to the invention, the antenna contours have essentially the same dimensions in the longitudinal direction and the transverse direction, extend essentially parallel to one another on either side of a dielectric material and are, in relation to one another, symmetrically located on either side of the dielectric material.

The connections 234, 245 between the radiating elements 205, 215, 225 are suitably connected to the radiating elements in a centred manner in relation to the extension of the respective antenna contour in the longitudinal direction.

The embodiment shown in FIG. 2*a* also comprises a feed point 260 and a ground connection point 270, which will be described in greater detail below with reference to FIG. 3.

As shown by dashed lines in FIG. 2*a*, the antenna arrangement 200 according to the invention may consist of an, on the whole, arbitrary number of radiating elements. Furthermore, the radiating elements may be designed in a great many different geometrical shapes, but in the preferred embodiment shown in FIG. 2*a* they consist of rectangular patches 205, 215, 225.

The connection between the two antenna contours may also be designed in a great many different ways. FIG. 2*a* shows an example in which the connections consist of via holes 255, 265, 275, 285, 295, 298 positioned adjacently to the edges of the patches located in the longitudinal direction of the contours, along a line that constitutes an imaginary centre line in the longitudinal direction of the two antenna contours. When this type of connection is used, the connections should not be located further from one another than $\lambda/8$, where $\lambda$ is the centre frequency in the waveband for which the antenna is intended.

Figure 2B:
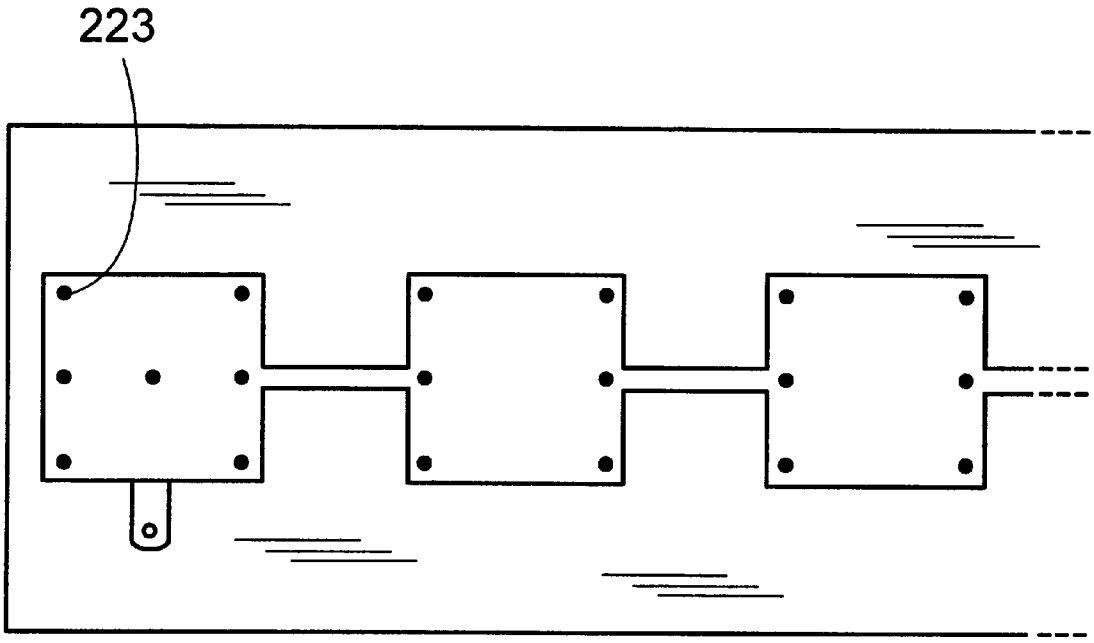
FIG. 2*b* shows an arrangement according to an alternative preferred embodiment of the invention, seen from above.

FIG. 2*b* shows a slightly different embodiment of the arrangement according to the invention. In the embodiment shown in FIG. 2*b*, connections between the two antenna contours have been positioned on the one hand as shown in FIG. 2*a* and on the other hand in the corners of the radiating elements. An arrangement according to the invention may have connections 223 added to it in the manner shown in FIG. 2*b* if it is desirable to further increase the effect of the two antenna contours being interconnected. The additional connections are then suitably positioned in concentration points in the electric field and/or in points along the periphery of the contours.

An alternative possibility for interconnecting the first and the second antenna contours is to have a continuous connection which preferably extends in the longitudinal direction of the contours, essentially along the length of the entire arrangement. In other words, such a connection forms a longitudinal groove of electrically conductive material.

A further possibility for interconnecting the first and the second antenna contours is to have one or more connections which extend(s) along all or parts of the outer edges of the contours.

Figure 3:
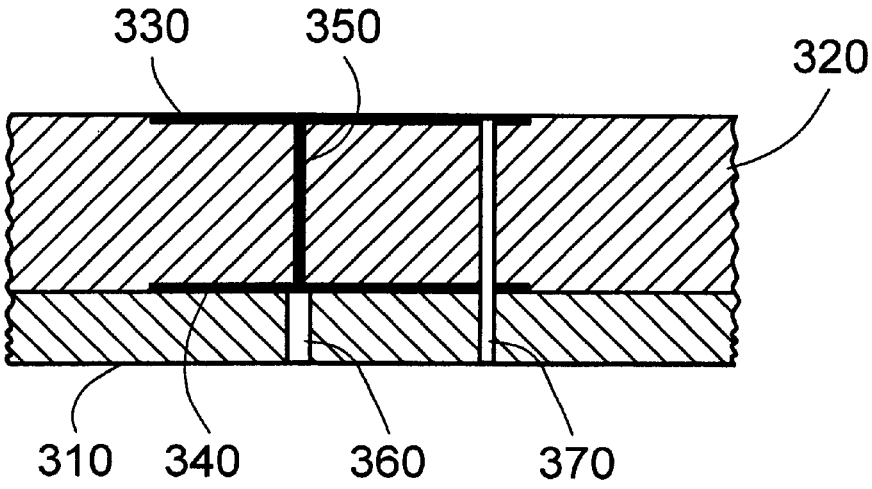
FIG. 3 shows a cross-section of the arrangement in FIG. 2*a*, seen from the front along section A—A.

Finally, FIG. 3 shows a cross-section of the arrangement in FIG. 2*a*, seen from the front along section A—A. In FIG. 3, the positioning and functioning of the grounding point 370 and the feed point 360, with which the arrangement is provided in this embodiment, can be seen.

The grounding point 370 is connected to the antenna contours 330, 340 by a "tongue" which projects from the respective antenna contour. In this "tongue", there is an aperture into which the grounding point fits.

The feed point 360 is the point at which the antenna arrangement is connected to other equipment, in the case of an antenna especially transmitting or receiving equipment. FIG. 3 shows an example of the positioning of this point, namely along the same line as the via holes. It is also possible to connect the antenna arrangement indirectly via, for example, slots located in a ground plane.

The invention is not limited to the embodiments described above but may be varied within the scope of the patent claims below. A microstrip arrangement according to the invention may be used in principle in all applications where it is desirable to minimize the influence of the dielectric material.

What is claimed is:

1. A single-frequency antenna arrangement comprising a ground plane, a dielectric substrate, a first antenna contour located on a first side of the dielectric substrate, and a second antenna contour located on a second side of the dielectric substrate, wherein the ground plane is located below the first and second antenna contours, on one side of and parallel to one of the antenna contours, so that it faces away from a direction in which the antenna arrangement radiates, and the first antenna contour and the second antenna contour:

have substantially the same dimensions in the longitudinal directions and the transverse directions, are galvanically interconnected by at least one connection, extend substantially parallel to one another on eider side of the dielectric substrate, as a result of which the field losses of the antenna arrangement in the dielectric substrate are minimized, and are symmetrically located, in relation to each other, on either side of the dielectric substrate.

2. The single-frequency antenna arrangement according to claim 1, wherein each antenna contour comprises a group of radiating elements which are interconnected by a group of connecting lines.

3. The single-frequency antenna arrangement according to claim 2, wherein the radiating elements are substantially rectangular.

4. The single-frequency antenna arrangement according to claim 1, wherein the connection that connects the first antenna contour to the second antenna contour is located along a line that forms an imaginary center line in the longitudinal direction of the antenna arrangement.

5. The single-frequency antenna arrangement according to claim 1, wherein the first antenna contour is connected to the second antenna contour by via holes.

6. The single-frequency antenna arrangement according to claim 5, wherein the via holes are located at a maximum distance of $\lambda/8$ from one another, where $\lambda$ is the wavelength for which the antenna arrangement is principally intended.

7. The single-frequency antenna arrangement according to claim 5, wherein the via holes are located adjacent to the edges of the radiating elements located in the longitudinal direction of the contours.

8. The single-frequency antenna arrangement according to claim 5, wherein the via holes are located adjacent to the corners of the radiating elements.

9. The single-frequency antenna arrangement according to claim 4, wherein the first antenna contour is connected to the second antenna contour by a continuous connection.

10. The single-frequency antenna arrangement according to claim 1, wherein the first antenna contour is connected to the second antenna contour by a connection that extends along all or parts of the outer edges of the contours.

* * * * *